US007055283B2

(12) United States Patent
Hsieh

(10) Patent No.: US 7,055,283 B2
(45) Date of Patent: Jun. 6, 2006

(54) CONTROL SYSTEM FOR DOOR OPENER

(76) Inventor: Chung Hsien Hsieh, No. 25-1, Fen-Liao Road, Linkou Hsiang, Taipei Hsien 244 (TW)

( * ) Notice: Subject to any disclaimer, the term of this patent is extended or adjusted under 35 U.S.C. 154(b) by 189 days.

(21) Appl. No.: 10/776,915

(22) Filed: Feb. 11, 2004

(65) Prior Publication Data

US 2005/0172559 A1 Aug. 11, 2005

(51) Int. Cl.
*E05F 15/00* (2006.01)

(52) U.S. Cl. ..... 49/139; 74/625 R; 160/188; 192/12 D

(58) Field of Classification Search ..... 49/139, 49/140; 74/625 R; 192/12 D; 160/188, 160/189, 133, 201
See application file for complete search history.

(56) References Cited

U.S. PATENT DOCUMENTS 3,853,167 A * 12/1974 Wardlaw ..... 160/133
5,839,555 A * 11/1998 Hsieh ..... 192/223.1
6,055,885 A * 5/2000 Shea ..... 74/625
6,092,582 A * 7/2000 Liu ..... 160/310
2002/0111242 A1* 8/2002 Balli et al. ..... 475/149

* cited by examiner

*Primary Examiner*—Jerry Redman
(74) *Attorney, Agent, or Firm*—Bucknam & Archer; Joseph J. Orlando

(57) ABSTRACT

A control system for switching an electric operation to a manual operation of a door opener comprises: a housing 11, including a power unit 12 driving a shaft 120 electrically and transmitting the power to an output shaft 16; a braking device 13, used for braking the shaft 120 and releasing the shaft 120; a pull-chain disk device 15 allowed for exerting an external force via a pull chain 152 to rotate the shaft 120; a clutch device 18, disposed between the shaft 120 and the pull-chain disk device 15, used for unidirectionally rotating the shaft 120 controllably when the pull-chain disk device is rotated by the external force; a protective device 17 used for cutting off a circuit of a door opener 10' in an abnormal mode; and a driven disk 158 interlocked with the clutch device 18 so as to swing by an angle for actuating the protective device 17 to switch. As such, the circuit of the door opener 10' is cut off and the brake is released jointly to automatically switch to a safe manual mode in any situation, once the pull chain 152 is pulled.

15 Claims, 9 Drawing Sheets

CONTROL SYSTEM FOR DOOR OPENER

BACKGROUND OF THE INVENTION

The present invention is related to an electric/manual operation switching control system for a door engine, particularly to a door engine allowed for jointly cutting off circuit and releasing brake so as to automatically switch to a safe manual mode in any situation only if a pull chain is pulled; while a door engine with a self-braking device and an interlocking pull-chain disk device is disclosed in the present invention.

DESCRIPTION OF THE PRIOR ART

Accordingly, in the conventional electric doors, such as roll doors or garage doors ascending/descending vertically, roll doors rolling horizontally, garage doors opened/closed by 90°, and other door leafs opened/closed electrically, as examples, an abnormal manual mode is provided except for an electric mode. Generally, for the safety consideration, there are extremely restrict requirements for the design of common electric doors. Once the door leaf ascends (opens) or descends (closes), there is a possibility of danger due to the man-made or accident factors, whether the electric door is operated in a normal electric mode or abnormal manual mode. The primary factor of potential danger comprises the self-slippage of the door leaf due to the weight of the door leaf itself under a power failure situation. Therefore, an appropriate balanced weight, based on the size, height, and weight of the door leaf, is commonly installed according to the design of the industry. Typically, a ring-type torsional spring element is provided passing through a reel of the door leaf. By means of the counter torque provided by the torsional spring, the weight of the door leaf may be balanced. Ideally, a balanced weight within ±35 lb for the door leaf is most safe and most easy for manipulation. In this case, any force exerted on the door leaf for pushing it upward or pulling it downward is inevitable less than 35 lb, regardless of the size or the height of the door leaf. This is the criterion commonly approved and followed by the industry.

Based on the aforementioned design requirements, the conventional door opener may be classified into three groups in accordance with the transmission structure through which the power is transmitted to an output shaft form a motor. According to this classification, the type of the door opener comprises: V-belt type, worm type, and spur gear type. The advantages and disadvantages of theses door openers may be described comparatively as follows:

(1) V-belt type: As illustrated in FIG. 1*a*, the power from a shaft 2 of a motor 1 is transmitted to a speed reducer 4 via a V-belt 3, and then transmitted to a final output shaft 5. Owing to an extremely large frictional force existed between the V-belt 3 and pulley pairs 2*a*, 4*a*, the braking effect of this door opener is achieved by the wear of the V-belt 3. When the power is abruptly cut off during the ascending/descending travel of the door leaf, the motor 1 of the door opener still slips down due to the inertia (especially in the slippage travel). At this time, the frictional force between the V-belt 3 and the pulley pairs 2*a*, 4*a* is utilized to timely generate the braking effect, such that the door leaf may be balanced as desired. The advantage of this kind of door opener resides in that none of additional braking device needed to be added. However, the disadvantages thereof reside in non-compact construction, large volume, heavy weight, and low efficiency; especially reside in time-consuming and laborious installation and maintenance.

(2) Worm type: As illustrated in FIG. 1*b*, the power from the shaft of the motor 1 is outputted to the speed reducer 4 via a worm (not shown in this figure), and then transmitted to the final output shaft 5. Owing to the feature of irreversibility and the extremely low transmission efficiency inherent in the worm transmission, the door leaf of this kind of the door opener never slips down even if the power is abruptly cut off during the ascending/descending travel of this door leaf. The merit of this kind of the door opener resides in that an automatic braking effect is provided without the need for additionally installing a braking device due to that feature of irreversibility. However, the imperfections thereof reside in a lower efficiency of approximately 45%, such that the power difference between the input and the output is extremely large, and in complex material and manufacture of the worm and worm gear. Moreover, owing to a non-compact construction of a casing, and a large volume, the cost of the door opener of this kind is much higher than that of the V-belt door opener.

(3) Spur gear type: It is the transmission means used in the door opener to which the present invention is related. In this case, the power from the shaft of the motor is transmitted to an output end directly via a plurality of spur gear pairs with a specific gear-ratio. Owing to a feature of reversibility inherent in the spur gear transmission, the door leaf may slip down incapable of being braked, especially in the descending travel, due to the inertia of the motor of the door opener and the weight of the door leaf (less than 35 lb), if the power is cut off abruptly during the ascending/descending travel of the door leaf of this door opener. The merits of this kind of the door opener are compactness as well as miniaturization, simple construction as well as low cost, and extremely high transmission efficiency of greater than 95%. However, the imperfection thereof is the feature of reversibility, such that a braking device must be added to balance the door leaf as desired. For the purpose of eliminating the imperfections of the door opener of this kind, an electromagnet means 224, braked electrically and interlocked with a pull-chain disk device in a manual mode, is provided in U.S. Pat. No. 6,055,885, issued to the present inventor, as illustrated in FIG. 1*c*. If a motor 211 is electrified, the electromagnet means 224 may attract a pull-chain disk 225 (i.e., brake disk) to release the brake; while if the power is cut off abruptly, the pull-chain disk 225 is pushed against a clutch lining 226 fixed at a shaft 332 by a spring 2242 to brake, and the shaft 221 may be driven by pulling a pull chain in the manual mode.

In view of the increased cost, the inclusion of control lines, and the assembly of more parts as well as accessories, etc., resulted from electrical brake, in other words, the increased probability of breakdown, the technical level of technology, and the enlarged volume, the present inventor considers that a simplified construction, miniaturized volume, and reduced cost may be provided for a roll door of this kind, i.e., if a part of power is sacrificed, namely, the shaft of the door opener is permanently rubbed against a braking friction plate via a brake disk to generate a self-locking brake, such that the roll door may be balanced as desired. The inventor further contemplates that, for the door opener in an ideal case, once the pull chain is pulled, then the circuit is cut off and the brake is released jointly to automatically switch to a safe manual mode. Thereby, it is intended by the inventor to develop this present invention.

SUMMARY OF THE INVENTION

It is the primary object of the present invention to provide an electric/manual operation switching control system for a door opener allowed for jointly cutting off the circuit and releasing the brake so as to automatically switch to a safe manual mode in any situation only if a pull chain is pulled.

The control system according to the present invention comprises a housing accommodating a power unit driving a shaft electrically and transmitting the power to an output shaft; a braking device used for braking the shaft and releasing the shaft; a pull-chain disk device rotating the shaft indirectly by an external force exerted through a pull chain in a manual mode; a clutch device, disposed between the shaft and the pull-chain disk device, allowed for a restrainedly unidirectional transmission; a protective device used for cutting off the circuit of the door opener in an abnormal situation; a driven disk interlocked with a clutch device for switching the protective device.

It is another object of the present invention to provide a door opener with a self-braking device, used for balancing a door leaf as desired and allowed for operating the door leaf by hand in a manual mode. For achieving this object, the present invention comprises:

a housing surrounding a first accommodating room and a second accommodating room partitioned by a rear cover; a power unit accommodated within the first accommodating room for driving a shaft; a first end of the shaft transmitting the power to an output shaft via a plurality of spur gear pairs, while a second end thereof pivoted on the rear cover and provided for extending in the second accommodating room; a braking device, accommodated within the second accommodating room, comprising a brake disk installed with a brake lining on one side thereof and fixed, at the center thereof, on the second end of the shaft to be rotated with the shaft together, a fixed plate located on the right side of the brake disk and formed with a pair of projecting pins at two opposite edges of a peripheral thereof, said fixed plate being fixed on the rear cover by a plurality of threaded fixing parts, each passing through a respective sleeve; a braking friction plate, disposed on the opposite side of the brake disk, formed with a plurality of axial through-open slots, at the positions corresponding to the sleeves on the fixed plate, for accommodating the sleeves such that the axial slide of the braking friction plate along the sleeves is obtained; a compression spring having two ends, one of which is provided for passing through a bearing support of the rear cover, and the other is butted against the braking friction plate to push the latter toward the brake lining for achieving an abuttingly braking state; an U-shaped sway plate having two legs, each pivoted on the corresponding projecting pin at each side of the fixed plate, the sway plate linked with a pull rod at the bottom thereof for pushing the braking friction plate toward a position not abutted against the brake lining, and extending a branch arm on the pull rod in a swing direction; a sensor switch fixed on the rear cover, including an abutting arm at a position not abutted against the branch arm, but allowed to be abutted against it in another situation. As such, when the power unit rotates, the permanent friction provided by the brake lining on the braking friction plate is used for generating the self-locking brake to balance the door leaf as desired, if the power is cut off abruptly during the ascending/descending travel of the door leaf; or the circuit of the door opener 10 may be cut off and the brake may be released jointly in any situation, for automatically switching to a safe manual mode, only that pulling the pull rod is required.

It is still another object of the present invention to provide a door opener having a self-braking device and an interlocking pull-chain disk device, in which a door leaf may be operated by the pull-chain disk in a manual mode, except that the door leaf is balanced as desired by the self-locking brake.

In the present invention, the door opener is formed with a third accommodating room at the tail cover of the housing for accommodating the pull-chain disk separately. Moreover, a clutch device is designed between the shaft and the pull-chain disk device, such that the shaft may be rotated indirectly and restrainedly by the pull chain. The clutch device comprises a driven wheel fixed on the end portion of the second end of the shaft, and formed with a plurality of ratchets around the rim thereof, and a operating member used for restraining the driven wheel and having a central shaft hole at the top end thereof, an eccentric axial branch arm formed in a direction opposite to the driven wheel at the bottom end thereof, and two operating arms extending outside in diametrical direction on the left and right sides, respectively. The pull-chain disk device includes a pull-chain disk around which a pull chain is provided, pivoted on a central shaft of the tail cover, one side of the pull-chain disk being formed with a installation surface, while one side of the installation surface being further formed with a shaft pin pivoted in the shaft hole of the operating member, and on the installation surface a first through-hole being formed to be passed through by the branch arm of the operating member; a pair of positioning plates pivoted, at one end thereof, on the other side of the installation surface, and each hooking a tension spring in the middle thereof, respectively, such that a clamping potential energy may be stored between free ends for clamping two sides of the branch arm of the operating member to keep that operating member in a balance state; a driven disk coaxial with the pull-chain disk and on the right side thereof, the driven disk including a turning plate provided for extending in a limit portion of the tail cover, one end of the driven disk, facing toward the pull-chain disk, being formed with a projecting sleeve, born at the outside of the branch arm of the operating member and formed with a sliding slot around the internal rim of the sleeve; a resilient annular part with tension, embedded in the sliding slot of the sleeve and allowed to frictionally slide on the surface of the sliding slot, while formed with a pair of retaining arm, extending toward the center and allowed to abut against the branch arm, at two ends of the annular part. In this manner, when the brake is released by the pull rod and the pull chain is then pulled so as to rotate the pull-chain disk and thus, the operating member, the deflection will be imparted to the operating member, due to the fact that the branch arm may be leaned against the retaining arm of the annular part in the rotary travel thereof and the annular part is provided with fiction resistance. As the operating member deflects, an abutting state of the operating arm with the ratchet of the driven wheel is presented, in such a way that the driven wheel may be rotated restrainedly, and the shaft is then rotated indirectly. Thus, the ascending/descending of the door leaf may be operated.

DETAILED DESCRIPTION OF THE INVENTION

Figure 1B:
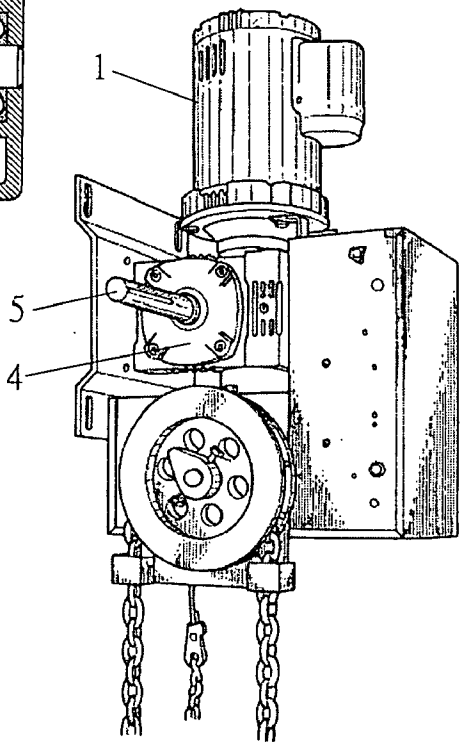
(PRIOR ART) FIG. 1b
FIG. 1*b* is a diagram of the appearance of a conventional worm type door opener.
Figure 1C:
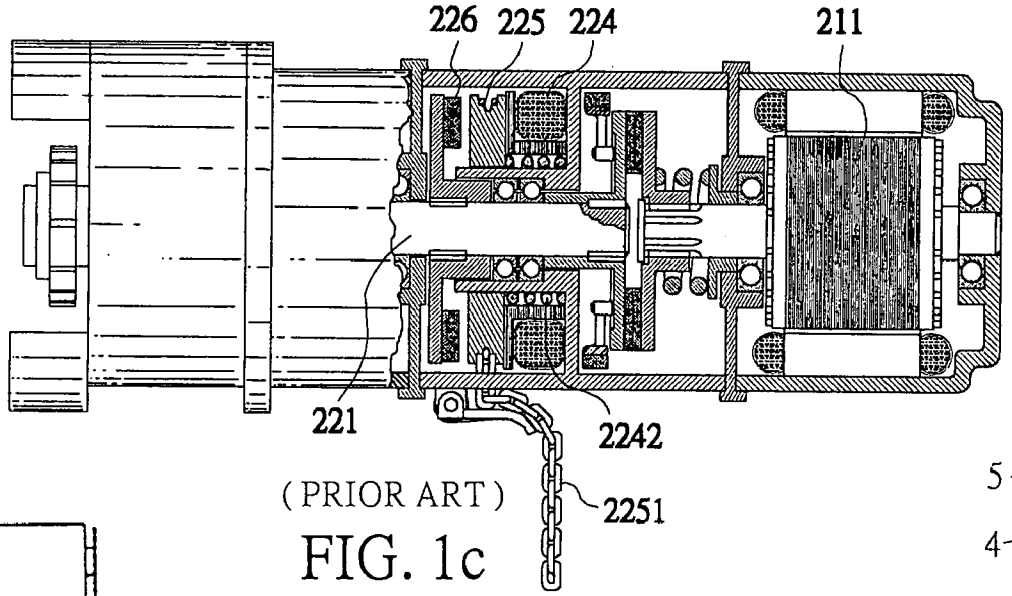
(PRIOR ART) FIG. 1c
FIG. 1*c* is a diagram of a door opener braked electrically, which is redrawn form The U.S. Pat. No. 6,055,885.
Figure 1A:
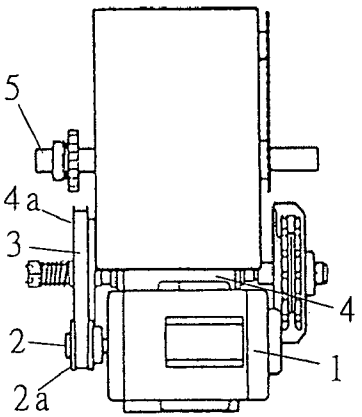
(PRIOR ART) FIG. 1a
FIG. 1*a* is a diagram of the appearance of a conventional V-belt type door opener.
Figure 2:
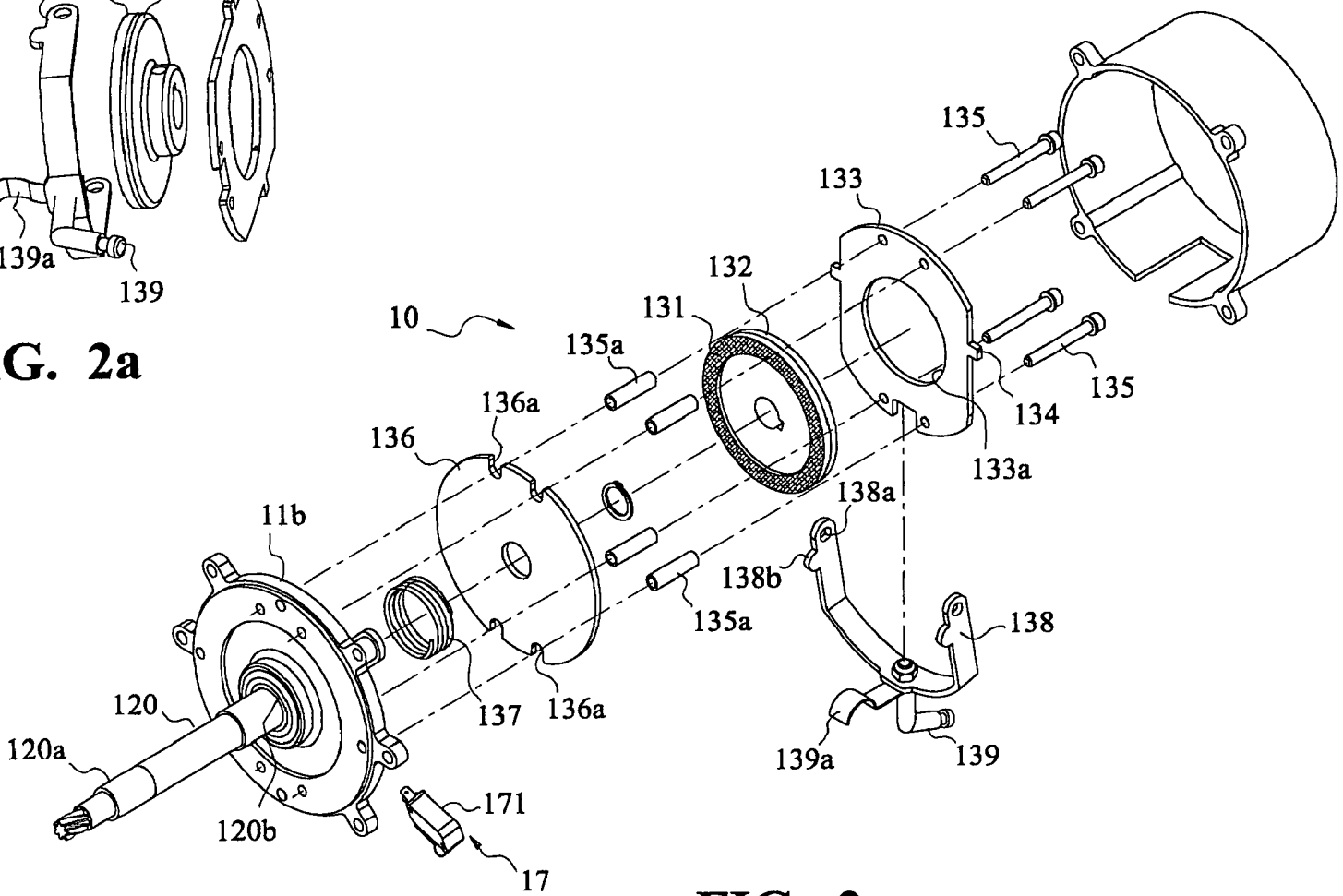
FIG. 2 is an exploded view of a door opener with a self-locking braking device according to one embodiment of the present invention, in which parts of members are omitted.
Figure 2A:
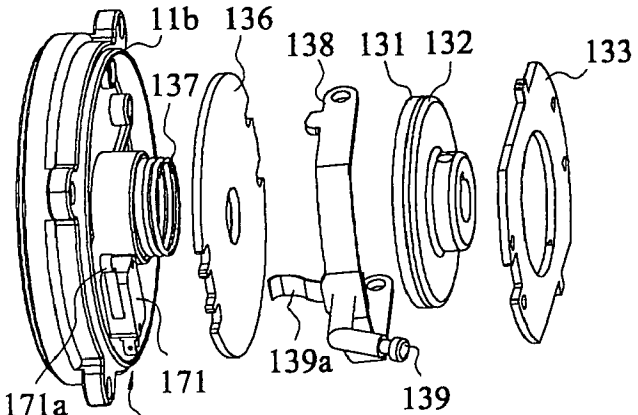
FIG. 2*a* is a substantially disassembled view observed from another angle according to the embodiment shown in FIG. 2.

Firstly, a door leaf, to which a door opener of the present invention pertains, is provided with a ring-type torsional spring element passing through a reel, as the typical one. By means of the counter torque provided by the torsional spring, the weight of the door leaf may be balanced. Ideally, a balanced weight within 35 lb for the door leaf is achieved, such that only an extremely small torque is required for the door opener to roll the door leaf. The technical features of the present invention will be clearly appreciated from the following detailed description of the preferred embodiment, which is merely one preferred example and not considered as restrictive, taken in conjunction with the accompany drawings.

Refering to FIGS. 2, 2*a*, 3, and 3*a*, there is shown a door opener 10 having a self-locking braking device according to one embodiment of the present invention, comprising:

a housing 11 surrounding a space having a first accommodating room 11*a* and a second accommodating room 11*c* partitioned by a rear cover 11*b* inside thereof, a power unit 12, accommodated in the first accommodating room 11*a*, used for driving a shaft 120, the shaft 120 having a first end 120*a* and a second end 120*b*, the first end 120*a* extending outside the first accommodating room 11*a* and transmitting the power to an output shaft 16 via a plurality of spur gear pairs 14, and the second end 120*b* pivoted on the rear cover 11*b* and extending into the second accommodating room 11*c;* a braking device 13, including a brake disk 132 disposed in the second accommodating room 11*c* and having two sides, a brake lining 131 being installed on the side thereof facing to the power unit 12 and passed through by the second end 120*b* of the shaft 120 at the center of the brake disk 132 so as to be integrally fixed with the shaft 120 to rotate therewith; a fixed plate 133, disposed within the second accommodating room 11*c* on the right side of the brake disk 132, having a peripheral and formed with a pair of projecting pins 134 at two opposite edges of the peripheral, the fixed plate 133 being fixed on the rear cover 11*b* by a plurality of threaded fixing parts 135, each passing through a respective sleeve 135*a*; a braking friction plate 136, disposed within the second accommodating room 11*c* on the left side of the fixed plate 133, formed with a plurality of axial through-open slots 136*a*, at the positions corresponding to the sleeves 135*a* on the fixed plate 133, for accommodating the sleeves 135*a*, such that the axial slide of this braking friction plate along the sleeves 135*a* is obtained;

a compression spring 137 having two ends, one of which is installed on a bearing support 11*b*' at the right end face of the rear cover 11*b*, and the other is butted against the left end face of the braking friction plate 136 to push the latter toward the brake lining 131 for achieving an abutting state; an U-shaped sway plate 138 having two legs, each pivoted on the corresponding projecting pin 34 disposed at each side of the fixed plate 133, the sway plate linked with a pull rod 139 at the bottom thereof for pushing the braking friction plate 136 toward a position not abutted against the brake lining 131, and extendingly provided with a branch arm 139*a* on the pull rod 139 in a swing direction; a sensor switch 171, connected to the circuit of the door opener 10 and fixed on the rear cover 11*b*, including a abutting arm 171*a* at a position not abutted against the branch arm 139, but allowed to be abutted against it in another situation.

Figure 3:
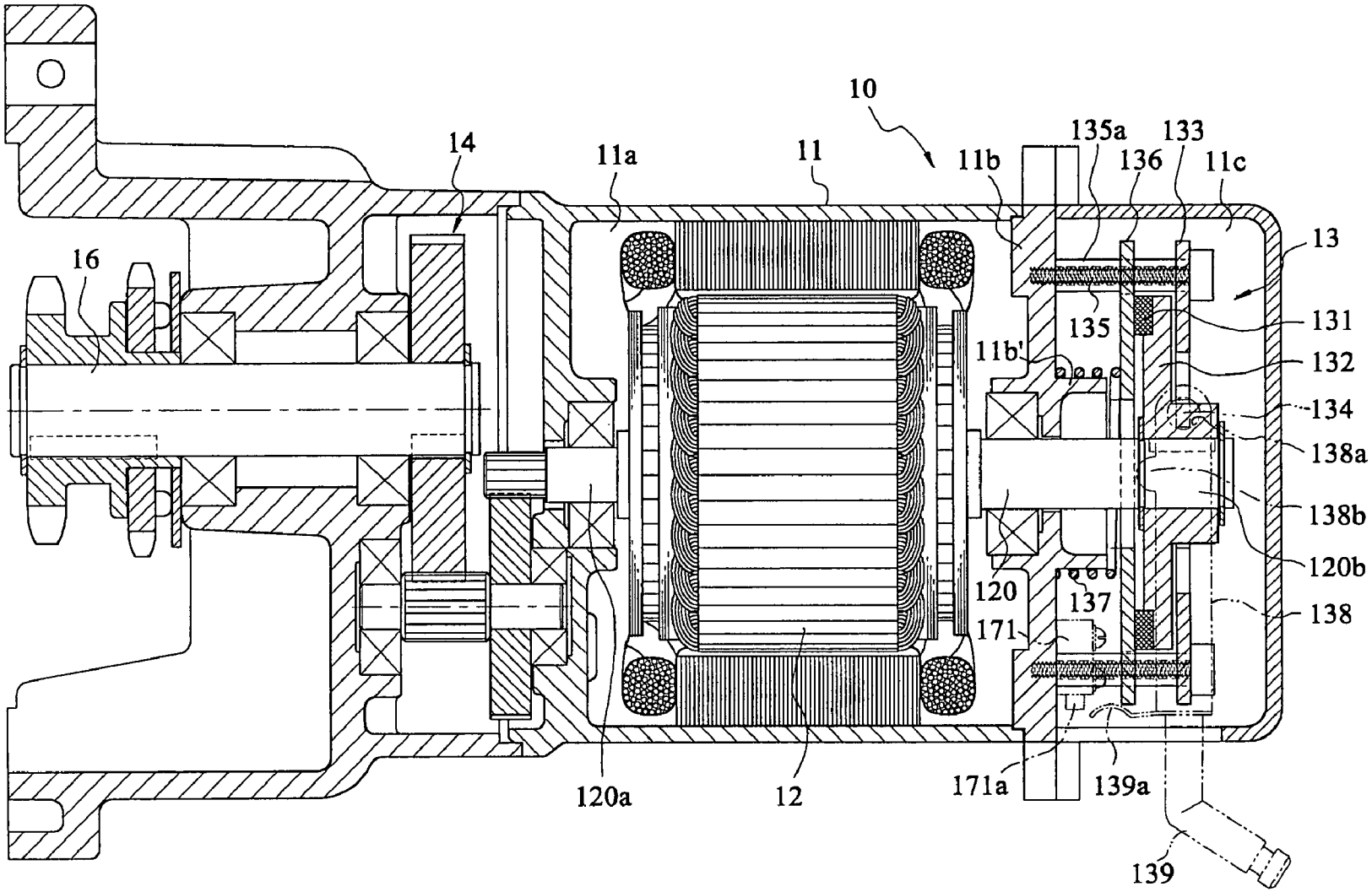
FIG. 3 is a cross section diagram illustrating the braking state according to the complete embodiment shown in FIG. 2.
Figure 3A:
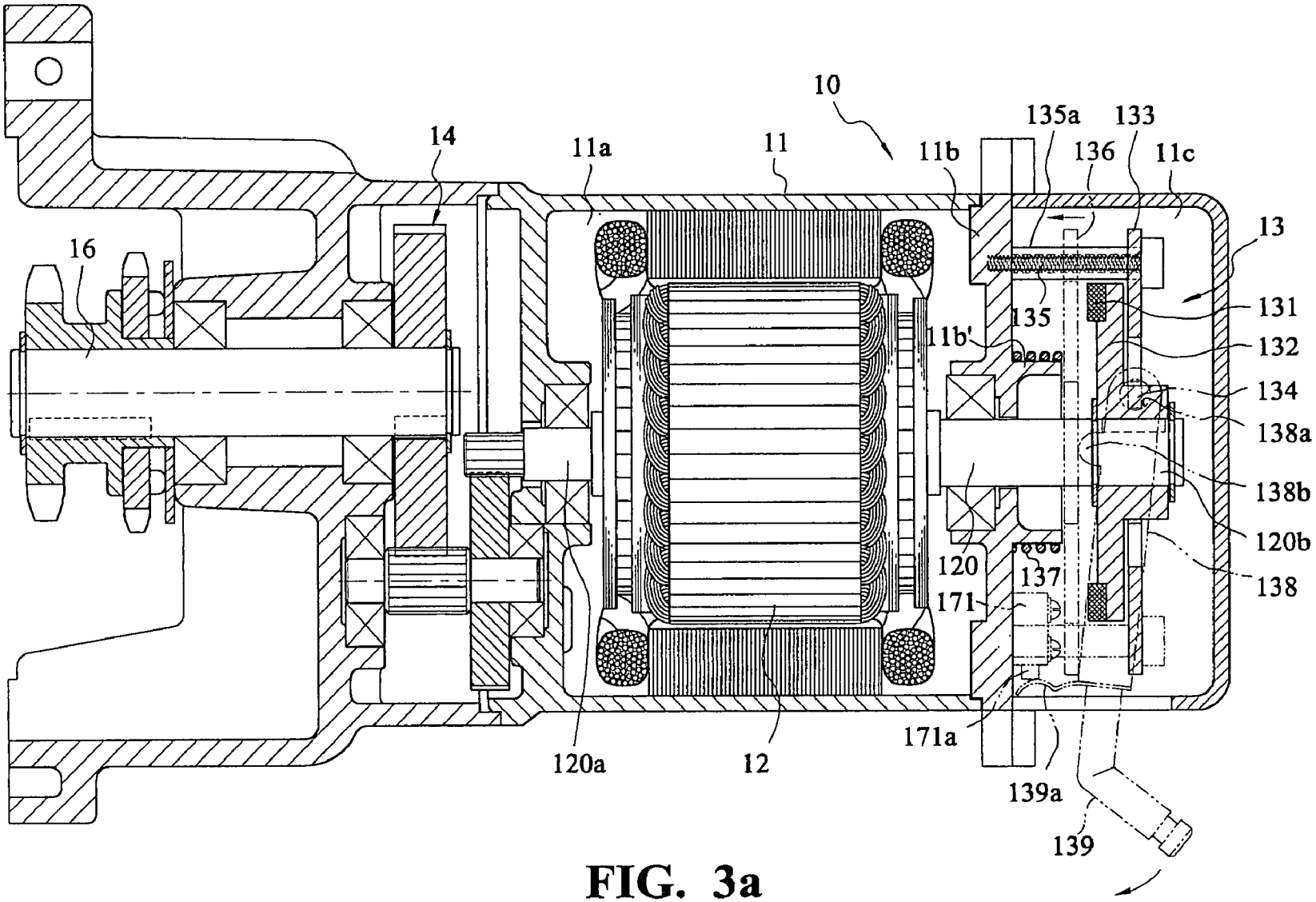
FIG. 3*a* is a diagram similar to FIG. 3, but the brake-releasing state is illustrated.

In this door opener 10, referring to FIG. 3, when the power unit 12 rotates, the permanent friction provided by the brake lining 131 on the braking friction plate 136 is used for generating the self-locking brake from the friction resistance to balance the door leaf as desired, if the power is cut off during the ascending/descending travel of the door leaf. Moreover, FIG. 3*a* shows a brake-releasing state, in which the circuit of the door opener 10 may be cut off and the break may be released jointly in any situation for automatically switching to a safe manual mode, allowed for manually operating the roll door under the state of power failure, only that pulling the pull rod 139 is required. As shown in this figure, due to the fact that shaft holes 138*a* at two ends of the U-shaped sway plate 138 is pivotally supported on the projecting pins 134 disposed at two sides of the fixed plate 138, the braking friction plate 136 is rejected off the brake lining 131 slidingly by a projecting edge portion 138*b*, formed at the side of the U-shaped sway plate, forcing against the pressure of the compression spring 137, when the pull rod 139 is pulled down. Meanwhile, during the swing travel of the pull rod 139, an abutting arm 171*a* of the sensor switch 171 may be abutted against the branch arm 139*a* for cutting off the circuit of the door opener 10. At this time, the door leaf may be manually opened or closed with a pushing or pulling force, which may be less than 35 lb.

In another preferred embodiment of the present invention, shown in FIGS. 4–8, there is provided with a door opener 10' having a self-locking braking device and an interlocking pull-chain disk device. In this embodiment, the door leaf may be operated by a pull-chain disk device 15 in a manual mode, except that the door leaf may be balanced as desired by the aforementioned self-locking braking device 13.

Figures 4, 4A:
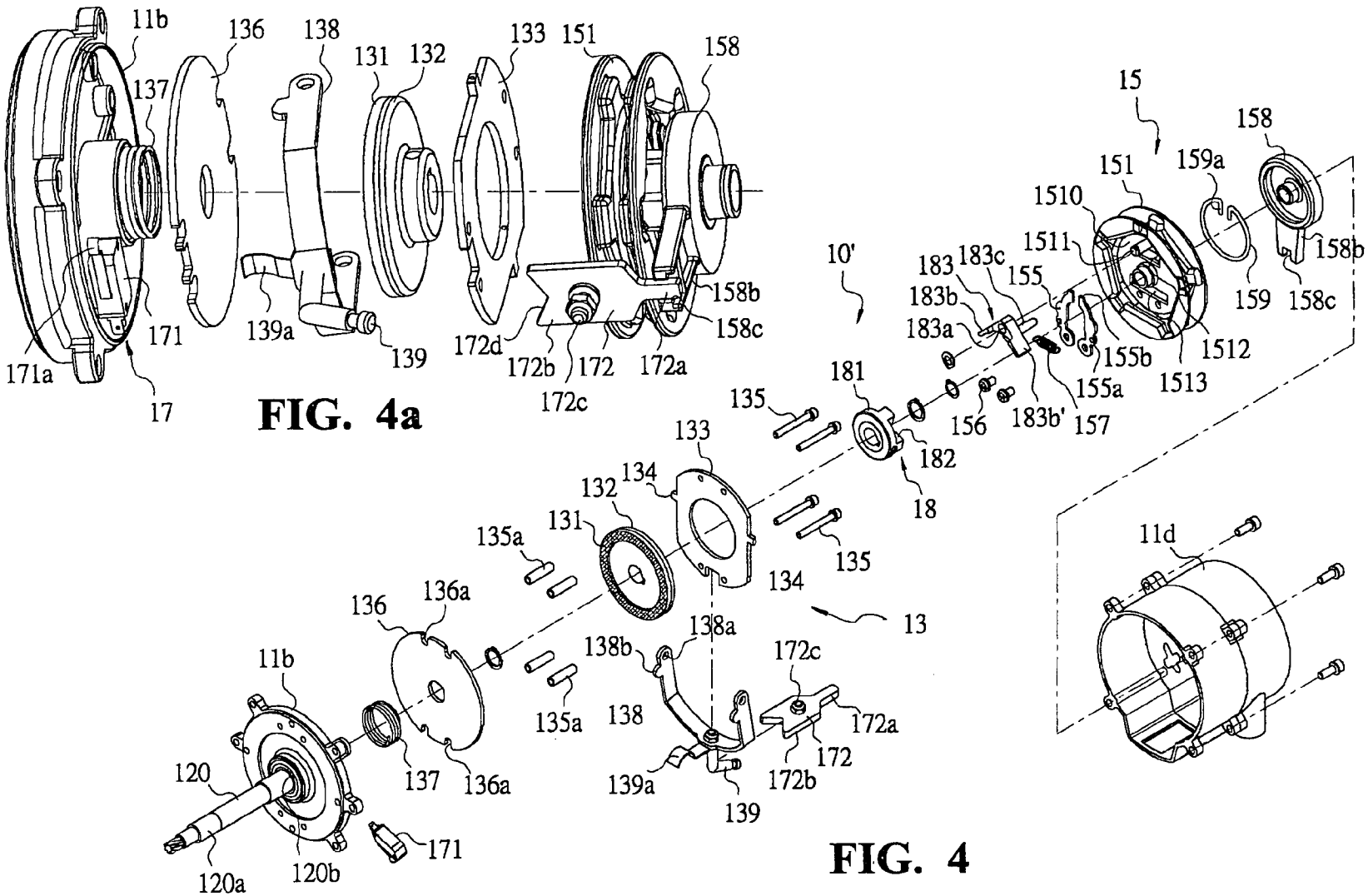
FIG. 4 is an exploded view of a door opener with a self-locking braking device and an interlocking pull-chain disk device according to one embodiment of the present invention, in which parts of members are omitted.
FIG. 4*a* is a substantially disassembled view observed from another angle according to the embodiment shown in FIG. 4.
Figure 4B:
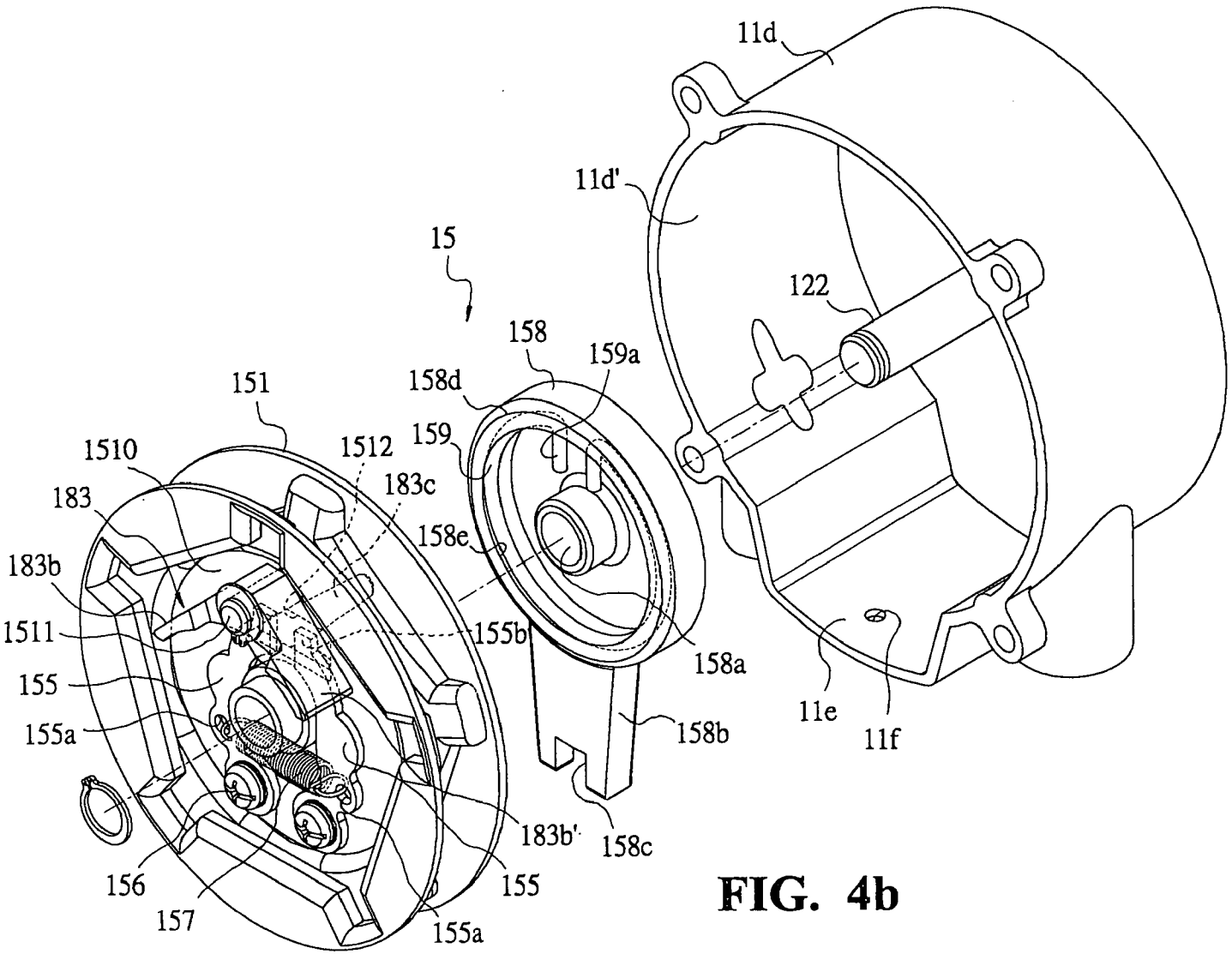
FIG. 4*b* is a substantially disassembled view showing a portion including the pull-chain disk device.
Figure 5:
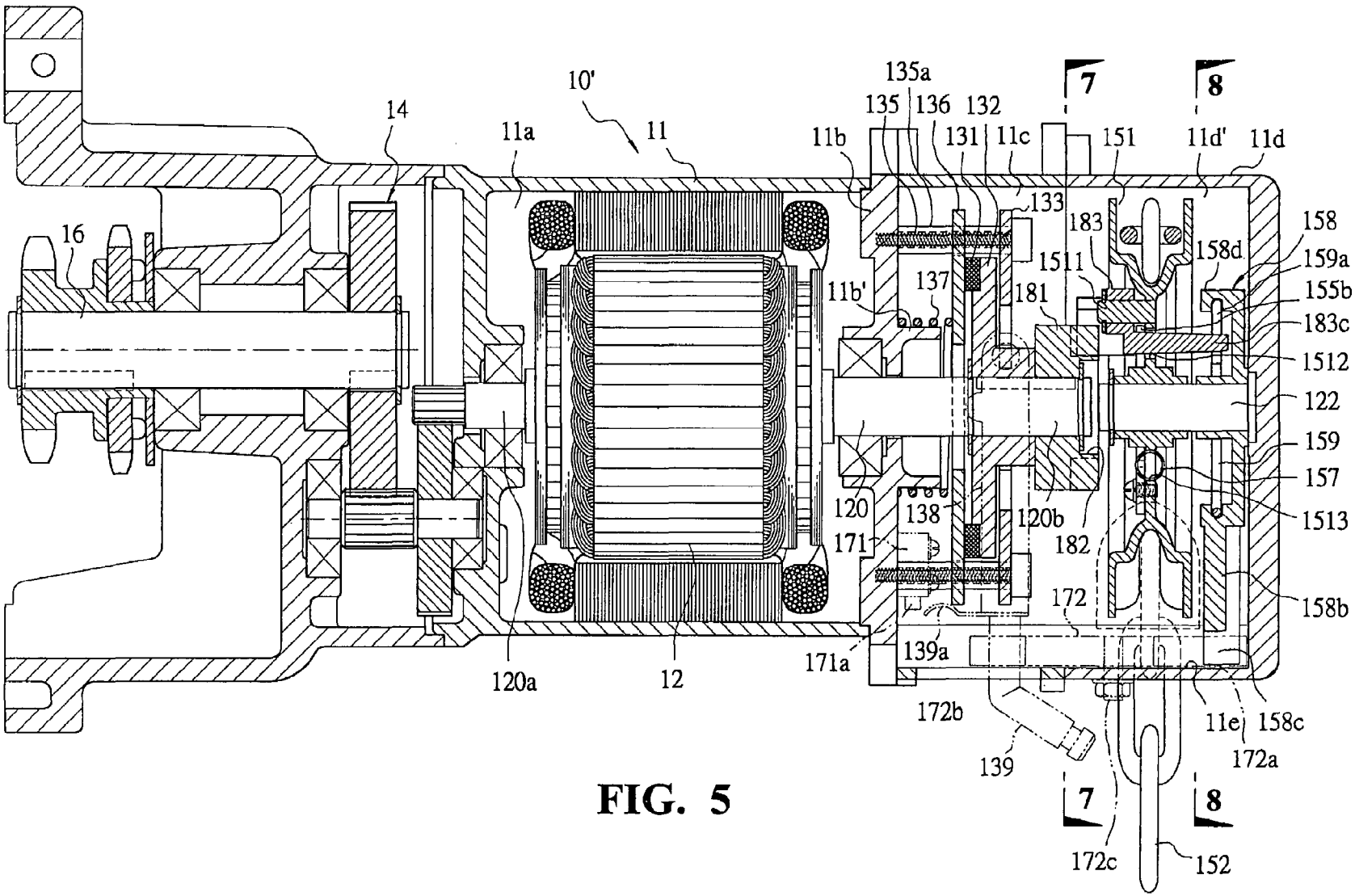
FIG. 5 is a cross section diagram illustrating the braking state according to the complete embodiment shown in FIG. 4.
Figure 6:
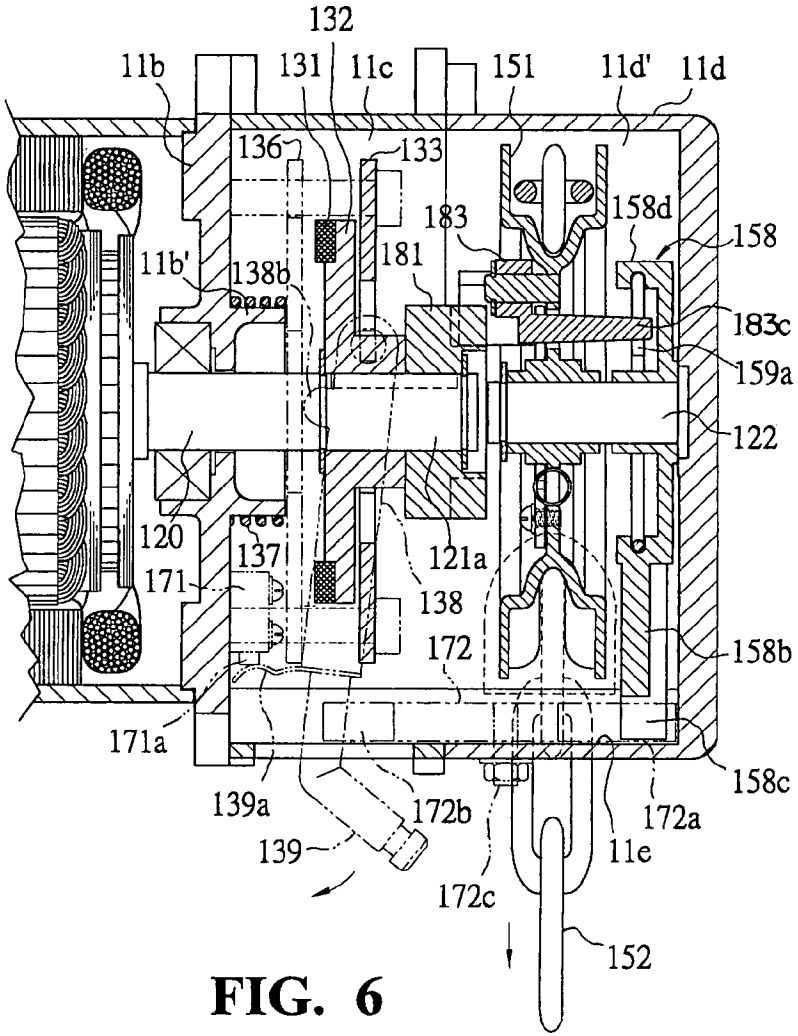
FIG. 6 is a partly cross section diagram similar to FIG. 5, showing the brake-releasing state after the pull chain is pulled.
Figure 8:
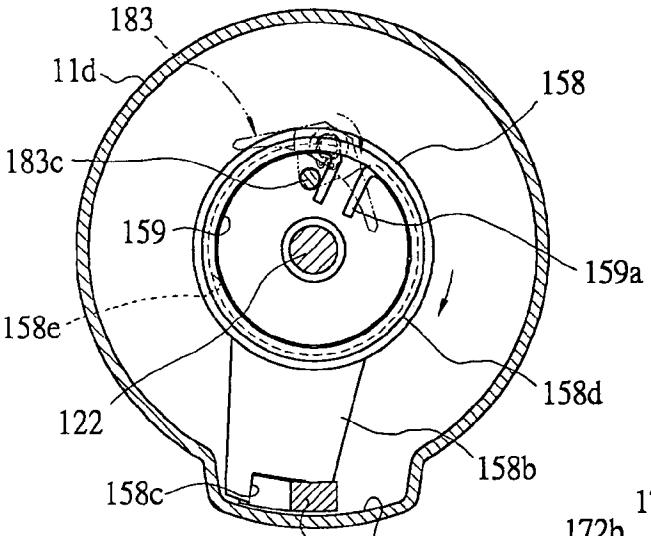
FIG. 8 is a cross section diagram taken along the line 8—8 in FIG. 5.
Figure 6A:
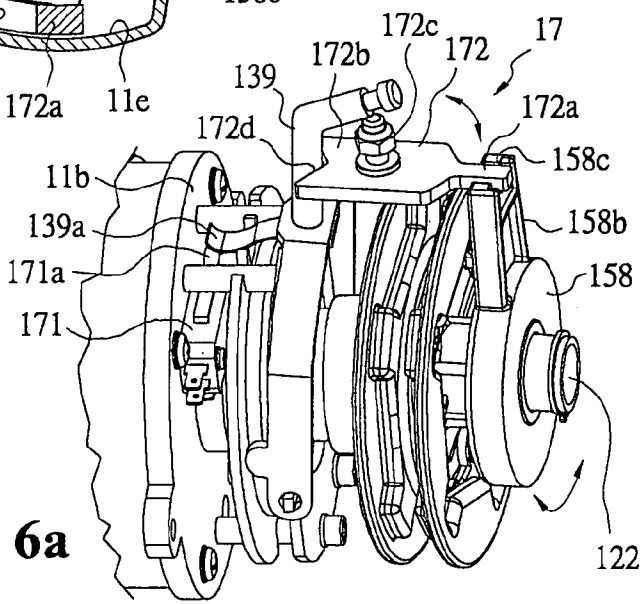
FIG. 6*a* is a perspective view of the interlocking device shown in FIG. 6, but observed from another angle, in which parts of members are omitted.

The present invention comprises: a housing 11 surrounding a space with two openings, the interior of the space being partitioned by a rear cover 11*b* into a first accommodating room 11*a*, a second accommodating room 11*c*, one of said openings being interconnected with an opening of a tail cover 11*d*, presented as a hollow cylinder, having a limit portion 11*e* at the bottom thereof for forming a third accommodating room 11*d'*;

a power unit 12, accommodated in the first accommodating room 11*a*, for driving a shaft 120, the shaft 120 having a first end 120*a* and a second end 120*b*, the first end 120*a* extending outside the first accommodating room 11*a* and transmitting the power to an output shaft 16 via a plurality of spur gear pairs 14, while the second end 120*b* pivoted on the rear cover 11*b* and provided for extending within the second accommodating room 11*c*;

a self-locking braking device 13 including a brake disk 132 which, disposed within the second accommodating room 11*c*, comprises two sides, a brake lining 131 being installed on the side thereof facing to the power unit 12 and passed through by the second end 120*b* of the shaft 120 at the center of the brake disk 132 so as to be integrally fixed with the shaft 120 to rotate therewith; a fixed plate 133, disposed within the second accommodating room 11*c* on the right side of the brake disk 132, having a peripheral and formed with a pair of projecting pins 134 at two opposite edges of the peripheral, the fixed plate 133 being fixed on the rear cover 11*b* by a plurality of the threaded fixing parts 135, each passing through a respective sleeve 135*a*; a braking friction plate 136, disposed within the second accommodating room 11*c* on the left side of the fixed plate 133, formed with a plurality of axial through-open slots 13*a*, at the positions corresponding to the sleeves 135*a* on the fixed plate 133, for accommodating the sleeves 135*a* such that the axial slide of this braking friction plate along the sleeves 135*a* is obtained; a compression spring 137 having two ends, one of which is installed on a bearing support 11*b*' at the right end face of the rear cover 11*b*, and the other is butted against the left end face of the braking friction plate 136 to push the latter toward the brake lining 131 for achieving an abutting state; an U-shaped sway plate 138 having two legs, each pivoted on the corresponding projecting pins 134 at each fixed plate 133, the sway plate being linked with a pull rod 139 at the bottom thereof for extending outside the housing 11 and used for pushing the braking friction plate 136 toward a position not abutted against the brake lining 131, while the pull rod 139 being extendingly provided with a branch arm 139*a* in a swing direction;

a clutch device 18, including a driven wheel 181 fixed, at the center thereof, on the end portion of the second end 120*b* of the shaft 120 and formed with a plurality of ratchets 182 around the rim thereof, and an operating member 183 used for restraining the driven wheel 181, the operating member 183 further comprising a central shaft hole 183*a* at the top end thereof, an eccentric axial branch arm 183*c* formed in a direction opposite to the driven wheel 181 at the bottom end thereof, and operating arms 183*b*, 183*b*' extending outside in diametrical direction on the left and right sides, respectively.

a pull-chain disk device 15 including a pull-chain disk 151 accommodated within the third accommodating room 11*d*', the center of the pull-chain disk 151 being pivoted on a central shaft 122 of the tail cover 11*d* and a peripheral thereof is wrapped around a pull chain 152, one side of the pull-chain disk 151 opposite to the shaft 120 being formed with an installation surface 1510, while the side of the installation surface 1510 being further formed with a shaft pin 1511 pivotally supported in the shaft hole 183*a* of the operating member 183, and on the installation surface 1510 a first through-hole 1512 being formed to be passed through by the branch arm 183*c* of the operating member 183; a pair of positioning plates 155 pivotally supported, at one end thereof, on the other side of the installation surface 1510 by a pair of threaded fixing parts 156, and each having a groove 155*a* in the middle thereof, while the other end 155*b* thereof being presented as a free end 155*b*; in which, a second through-hole 1513 accommodating a tension spring 157 is provided on the installation surface 1510 between two positioning plates 155, and two ends of the tension spring 157 are hooked in the grooves 155*a* of the positioning plates 155, respectively, such that a claming potential energy may be stored between the free ends 155*b* of the pair of positioning plates 155 for clamping two sides of the branch arm 154*c* of the operating member 154 to keep the operating member 154 in a balance state (as illustrated in FIG. 4*b*);

a driven disk 158, coaxial with the pull-chain disk 151, having a central hole 158*a* pivoted on the base end of the central shaft 122 of the tail cover 11*d*, the driven disk 158, including a turning plate 158*b*, provided for extending in the limit portion 11*e* of the tail cover 11*d*, allowed for swinging within the limit portion 11*e*, and further formed with a locking groove 158*c* at the end of the turning plate 158*b*, one end of the driven disk 158 facing toward the pull-chain disk 151 being formed with a projecting core tube 158*d*, born at the outside of the branch arm 183*c* of the operating member 183 and formed with a sliding slot 158*e* around the internal rim of the sleeve 158*d*; a resilient annular part 159 with tension, embedded in the sliding slot 158*e* of the core tube 158*d* and allowed to frictionally slide on the surface of the sliding slot 158*e*, while formed with a plurality of retaining arms 159*a* extending toward the center at two ends of the annular part 159; in which, the branch arm 183*c* of the aforementioned operating member 183 may pass through the first through-hole 1512 of the installation surface 1510 and then provided for extending inside the core tube 158*d* to finally lean against the retaining arms 159*a* of the annular part 159 (as illustrated in FIG. 8);

a protective device 17, including a sensor switch 171 connected to the circuit of the door opener 10' and fixed on the rear cover 11*b*, the sensor switch 171 including an abutting arm 171*a*, located at a position, against which the branch arm 139*a* may be abutted in the swing travel of the pull rod 139, and a rotary arm 172 disposed between the pull rod and the turning plate 158*b*, the rotary arm 172 having a first end 172*a* and a second 172*b*, and the middle of the rotary arm including a shaft pin 172*c* pivotally supported in a shaft hole 11*f* of the limit portion 11*e*, in which the first end 172*a* is accommodated in the locking groove 158*c* of the turning plate 158*b*, while the second end 172*b* is formed with a V-shaped opening 172*d* widened gradually outwardly, the interior of the V-shaped opening 172*d* being born on the pull rod 139 (as illustrated in FIG. 6*a*).

Figure 7A:
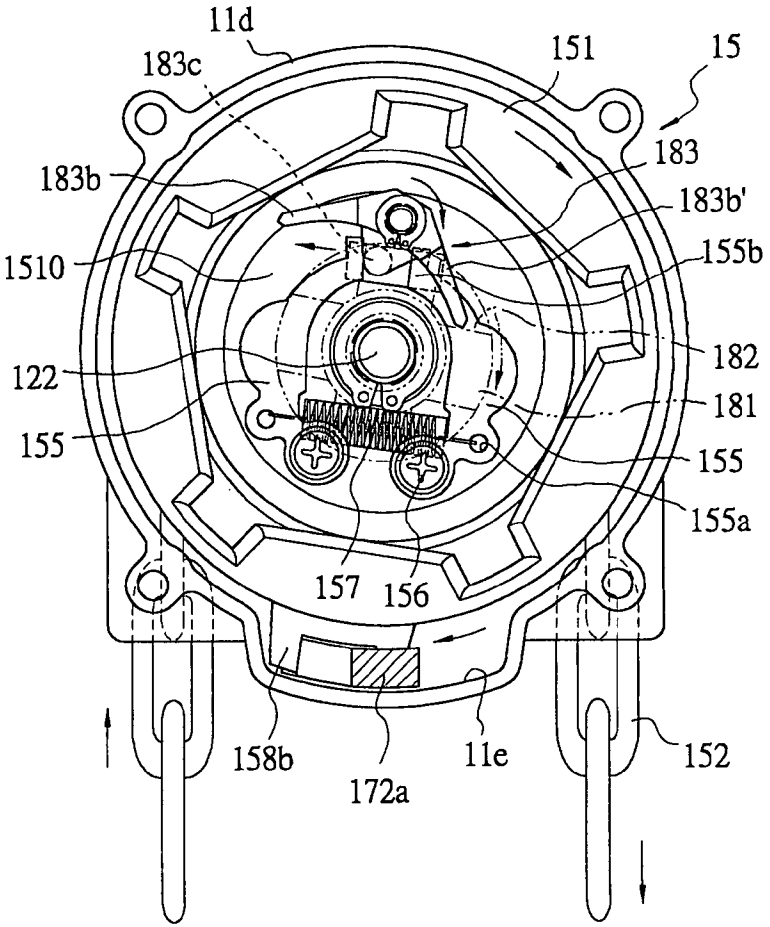
FIG. 7*a* is a diagram showing the operating member of FIG. 7 when it is presented in a deflection state.
Figure 7:
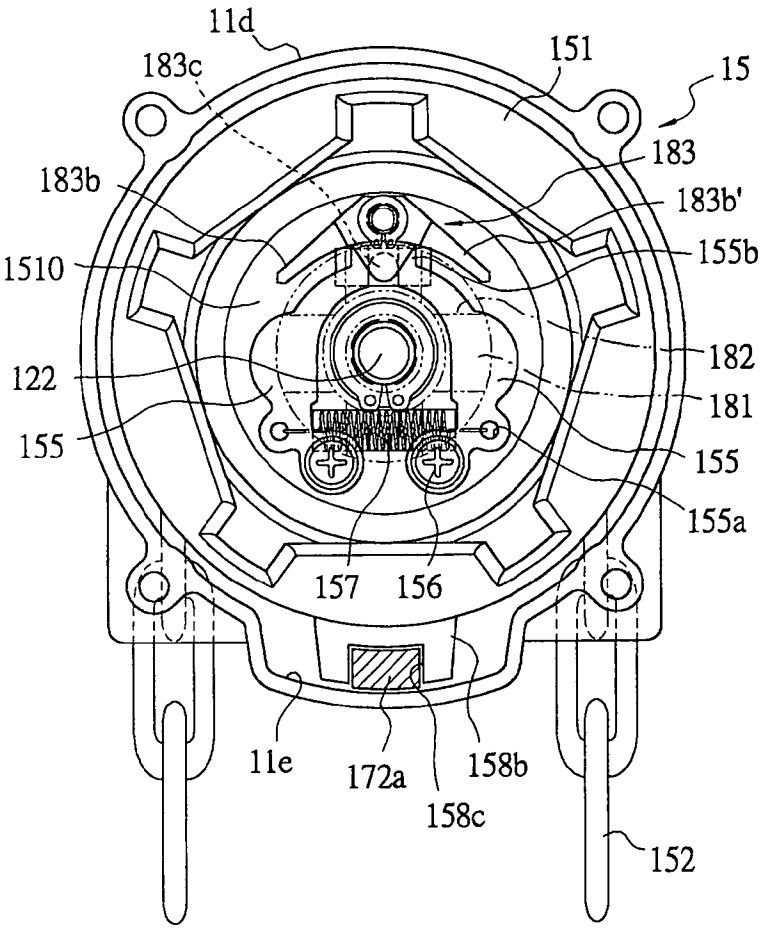
FIG. 7 is a cross section diagram taken along the line 7—7 in FIG. 5, where an operating member is presented in a balance state.

In the aforementioned door opener 10', a non-abutting state of the operating arms 183*b*, 183*b*' of the operating member 183 with the ratchet 182 of the driven wheel 181 of the clutch device 18 is presented when the operating member 183 is maintained in a non-deflected balance state, i.e., the pull chain 152 has not been pulled, as shown in FIG. 7. Further, referring to FIG. 7*a* in comparison with FIGS. 6, 6*a*, and 8, when the pull chain 152 is pulled and the pull-chain disk 151 is then rotated, the deflection will be imparted to the operating member 183, due to the fact that the branch arm

183*c* may be leaned against the retaining arms 159*a* of the annular part 159 in the rotary travel thereof and the annular part 159 is provided with friction resistance. As the operating member 183 deflects, an abutting state of the operating arms 183*b*, 183*b*' with the ratchet 182 of the driven wheel 181 is presented, so as to restrainedly rotate the driven wheel 181 and then rotate the shaft 120 indirectly. In the meantime, when the pull chain 152 is pulled to rotate the pull-chain disk 151, the branch arm 183*c* may be leaned against the retaining arms 159*a* of the annular part 159 and the driven disk 158 is thus rotated, such that the turning plate 158*b* in the lower end may be deflected by an angle within the limit range provided by the limit portion 11*e* (as illustrated in FIG. 8). On the other hand, as the first end 172*a* is turned by the locking groove 158*c* of the turning plate 158*b*, it is evident that the second end 172*b* may be rotated by an angle in an direction opposite to the turning, and a component of force may be simultaneously generated at the V-shaped opening 172*d* to push the pull rod off this opening along the inverse-taper edge, because the middle of the rotary arm 172 is pivoted on the limit portion 11*e* (as illustrated in FIGS. 6 and 6*a*). Except for releasing brake accomplished by pushing the braking friction plate 136 off the brake disk 132, the branch arm 139*a* is simultaneously contacted with the abutting arm 171*a* of the sensor switch 171 in order for cutting off the circuit of the door opener 10' during the swing travel of the pull rod 139, if the pull rod 139 swings. As such, in the non-manual mode, the power may be cut off immediately, if the pull chain is misoperated. In other words, once the pull chain 152 is pulled, whether in the electric or manual mode, the circuit of the door opener 10' is cut off interlocked with the release of the brake and the rotation of the shaft 120 so as to automatically switch to a safe manual mode. Thus, the safety is secured.

The aforementioned door opener may be applied for all door leafs opened and closed electrically, such as roll doors or garage doors ascending/descending vertically, roll doors rolling horizontally, or garage doors opened and closed by an angle of 90°. The foregoing description is merely one embodiment of present invention and not considered as restrictive. All equivalent variations and modifications in process, method, feature, and spirit in accordance with the appended claims may be made without in any way from the scope of the invention.

To sum up, the electric/manual operation switching control system of the present invention enables cutting off the circuit of the door opener interlocked with the release of the brake and the rotation of the shaft for automatically switching to a safe manual mode if the pull chain is pulled in any situation. Thus, the superior safety and the effect of simplified structure, miniaturized volume, and reduced cost for the door opener are achieved Therefore, this application is truly an invention with novelty, advancement, and availability by the industry.

List of Reference Numerals

10, 10' door opener
11 housing
11*a* first accommodating room
11*b* rear cover
11*b*' bearing support
11*c* second accommodating room
11*d* tail cover
11*e* limit portion
11*f* shaft hole
12 power unit
120 shaft
120*a* first end
120*b* second end
122 central shaft
13 braking device
131 brake lining (assembly)
132 brake disk
133 fixed plate
134 projecting pins 134
135 threaded fixing part
135*a* sleeve
136 braking friction plate
136*a* open slot
137 compression spring
138 sway plat
138*a* shaft hole
138*b* projecting edge portion
139 pull rod
139*a* branch arm
14 spur gear pair
15 pull-chain disk device
151 pull-chain disk
1510 installation surface
1511 shaft pin
1512 first through-hole
1513 second through-hole
152 pull chain
155 positioning plate
155*a* groove
155*b* free end
156 threaded fixing part
157 tension spring
158 driven disk
158*a* central hole
158*b* turning plate
158*c* locking pin
158*d* core tube
158*e* sliding slot
159 resilient annular part
159*a* retaining arm
16 output shaft
17 protective device
171 sensor switch
171*a* abutting arm
172 rotary arm
172*a* first end
172*b* second end
172*c* shaft pin
172*d* V-shaped opening
18 clutch device
181 driven wheel
182 ratchet
183 operating member
183*a* shaft hole
183*b*, 183*b* operating arm
183*c* branch arm

What is claimed is:

1. A control system for switching an electric operation to a manual operation of a door opener, comprising:

a housing 11, including a power unit 12 driving a shaft 120 electrically and transmitting the power to an output shaft 16;

a braking device 13, used for braking said shaft 120 and releasing said shaft 120;

a pull-chain disk device 15 allowed for exerting an external force via a pull chain 152 to rotate said shaft 120;

a clutch device 18, disposed between said shaft 120 and said pull-chain disk device 15, used for unidirectionally rotating said shaft 120 controllably when said pull-chain disk device is rotated by said external force;

a protective device 17 used for cutting off a circuit of a door opener 10'; and a driven disk 158 interlocked with said clutch device 18 so as to engage a U-shaped sway plate which swings by an angle and engages a sensor switch for actuating said protective device 17 such that said circuit of said door opener 10' is cut off and the braking device is released jointly to automatically switch to a safe manual mode, once said pull chain 152 is pulled.

2. The control system for switching electric operation to manual operation of door opener according to claim 1, wherein said braking device 13 comprises a brake disk 132 which, fixed at said shaft 120, is permanently rubbed against a braking friction plate 136 to generate a self-locking brake.

3. The control system for switching electric operation to manual operation of door opener according to claim 2, wherein said brake disk 132 is installed with a brake lining assembly 131 on one side surface, opposite to said braking friction plate 136.

4. The control system for switching electric operation to manual operation of door opener according to claim 2, wherein the potential energy of a compression spring 137 is stored in said braking friction plate 136 for pressing against said braking friction plate 136.

5. The control system for switching electric operation to manual operation of door opener according to claim 2, wherein said braking device 13 further comprises a fixed plate 133 fixed at a rear cover lib and guiding said braking friction plate 136 to slide axially through a plurality of sleeves 135*a*.

6. The control system for switching electric operation to manual operation of door opener according to claim 2, wherein said fixed plate 133 comprises a pair of projecting pins 134, at two sides thereof, pivotally supporting said U-shaped sway plate 138, and pushing said braking friction plate 136 off said brake disk 132 in order for releasing brake via a pull rod 139.

7. The control system for switching electric operation to manual operation of door opener according to claim 6, wherein said pull rod 139 is extendingly provided with a branch arm 139*a*, interlocked with said protective device 17, in a swing direction of said sway plate 138.

8. The control system for switching electric operation to manual operation of door opener according to claim 1, wherein said pull-chain disk device 15 comprises a pull-chain disk 151 around a peripheral of which said pull chain 152 is wrapped, such that cutting off said circuit of said door opener 10', releasing brake, and rotating said shaft 120 are achieved simultaneously by means of pulling said pull chain 152.

9. The control system for switching electric operation to manual operation of door opener according to claim 1, wherein said clutch device 18 comprises a driven wheel 181 disposed at said shaft 120, and an operating member 183 pivotally supported on said pull-chain disk device 15, both of which are combined together restrainedly when said operating member 183 is presented in an unbalance state.

10. The control system for switching electric operation to manual operation of door opener according to claim 9, wherein said operating member 183 is maintained in a balance state by means of a pair of positioning plates 155 installed on an installation surface 1510 of said pull-chain disk 151.

11. The control system for switching electric operation to manual operation of door opener according to claim 9, wherein said operating member 183 comprises an eccentric axial branch arm 183*c* operating said driven disk 158 when said pull-chain disk device 15 is manipulated.

12. The control system for switching electric operation to manual operation of door opener according to claim 11, further comprising a rotary arm 172 having a middle portion being pivotally supported and two ends interlocked with said driven disk 158 and said brake-releasing pull rod 139, respectively, for releasing brake when said pull-chain disk device 15 is manipulated.

13. The control system for switching electric operation to manual operation of door opener according to claim 12, wherein said circuit of said door opener 10' is cut off while said pull-chain disk device 15 is manipulated owing to the interlocking of a branch arm 139*a* with said sensor switch 171, when said pull rod 139 is operated by said rotary arm 172.

14. A door opener 10 with a self-locking braking device, used for balancing a door leaf as desired and allowed for operating said door leaf by hand in a manual mode, comprising:

a housing 11 surrounding a space having a first accommodating room 11*a* and a second accommodating room 11*c* partitioned by a rear cover 11*b* inside thereof;

a power unit 12, accommodated in said first accommodating room 11*a*, used for driving a shaft 120, said shaft 120 having a first end 120*a* and a second end 120*b*, said first end 120*a* extending outside said first accommodating room 11*a* and transmitting the power to an output shaft 16 via a plurality of spur gear pairs 14, and said second end 120*b* pivoted on said rear cover 11*b* and extending into said second accommodating room 11*c;* a brake disk 132 which, disposed within said second accommodating room 11*c*, comprises two sides, a brake lining assembly 131 being installed on one side thereof facing to said power unit 12 and passed through by said second end 120*b* of said shaft 120 at the center of said brake disk 132 so as to be integrally fixed with said shaft 120 to rotate therewith;

a fixed plate 133, disposed within said second accommodating room 11*c* on the right side of said brake disk 132, having a peripheral and formed with a pair of projecting pins 134 at two opposite edges of said peripheral, said fixed plate 133 being fixed on said rear cover 11*b* by a plurality of threaded fixing parts 135, each passing through a respective sleeve 135*a;* a braking friction plate 136, disposed within said second accommodating room 11*c* on the left side of said fixed plate 133, formed with a plurality of axial through-open slots 136*a*, at the positions corresponding to said sleeves 135*a* on said fixed plate 133, for accommodating said sleeves 135*a* such that the axial slide of this braking friction plate along said sleeves 135*a* is obtained;

a compression spring 137 having two ends, one of which is installed on a bearing support 11*b'* at the right end face of said rear cover 11*b*, and the other is butted against the left end face of said braking friction plate 136 to push the latter toward said brake lining 131 for achieving an abutting state;

an U-shaped sway plate 138 having two legs, each pivoted on said corresponding projecting pins 134 at each fixed plate 133, said sway plate being linked with a pull rod 139 at the bottom thereof for extending outside said housing 11 and used for pushing said braking friction plate 136 toward a position not abutted against said brake lining 131, while said pull rod 139 being extendingly provided with a branch arm 139*a* in a swing direction; and a sensor switch 171, fixed on said rear cover 11*b*, including an abutting arm 171*a* operated by being abutted against said branch arm 139 to cut off said circuit of said door opener 10, so as to jointly cut off said circuit of said door opener 10 and release brake for automatically switching to a safe manual mode once said pull rod 139 is pulled.

15. A door opener 10' with a self-locking braking device and an interlocking pull-chain disk device, used for balancing a door leaf as desired and allowed for operating said door leaf by a pull-chain disk device 15 in a manual mode, comprising:

a housing 11 surrounding a space with two openings, the interior of said space being partitioned by a rear cover 11*b* into a first accommodating room 11*a*, a second accommodating room 11*c*, one of said openings being interconnected with an opening of a tail cover 11*d*, presented as a hollow cylinder, having a limit portion 11*e* at the bottom thereof for forming a third accommodating room 11*d'*;

a power unit 12, accommodated in said first accommodating room 11*a*, for driving a shaft 120, said shaft 120 having a first end 120*a* and a second end 120*b*, said first end 120*a* extending outside said first accommodating room 11*a* and transmitting the power to an output shaft 16 via a plurality of spur gear pairs 14, while said second end 120*b* pivoted on said rear cover 11*b* and provided for extending within said second accommodating room 11*c*;

a self-locking braking device 13 including a brake disk 132 which, disposed within said second accommodating room 11*c*, comprises two sides, a brake lining 131 being installed on the side thereof facing to said power unit 12 and passed through by said second end 120*b* of said shaft 120 at the center of said brake disk 132 so as to be integrally fixed with said shaft 120 to rotate therewith;

a fixed plate 133, disposed within said second accommodating room 11c on the right side of said brake disk 132, having a peripheral and formed with a pair of projecting pins 134 at two opposite edges of said peripheral, said fixed plate 133 being fixed on said rear cover 11*b* by a plurality of threaded fixing parts 135, each passing through a respective sleeve 135*a*;

a braking friction plate 136, disposed within said second accommodating room 11*c* on the left side of said fixed plate 133, formed with a plurality of axial through-open slots 136*a*, at the positions corresponding to said sleeves 135*a* on said fixed plate 133, for accommodating said sleeves 135*a* such that the axial slide of this braking friction plate along said sleeves 135*a* is obtained;

a compression spring 137 having two ends, one of which is installed on a bearing support 11*b'* at the right end face of said rear cover 11*b*, and the other is butted against the left end face of said braking friction plate 136 to push the latter toward said brake lining 131 for achieving an abutting state;

an U-shaped sway plate 138 having two legs, each pivoted on said corresponding projecting pins 134 at each fixed plate 133, said sway plate being linked with a pull rod 139 at the bottom thereof for extending outside said housing 11 and used for pushing said braking friction plate 136 toward a position not abutted against said brake lining 131, while said pull rod 139 being extendingly provided with a branch arm 139*a* in a swing direction;

a clutch device 18, including a driven wheel 181 fixed, at the center thereof, on the end portion of said second end 120*b* of said shaft 120 and formed with a plurality of ratchets 182 around the rim thereof and an operating member 183 used for restraining said driven wheel 181, said operating member 183 further comprising a central shaft hole 183*a* at the top end thereof, an eccentric axial branch arm 183*c* formed in a direction opposite to said driven wheel 181 at the bottom end thereof, and operating arms 183*b*, 183*b'* extending outside in diametrical direction on the left and right sides, respectively;

a pull-chain disk device 15 including a pull-chain disk 151 accommodated within said third accommodating room 11*d'*, the center of said pull-chain disk 151 being pivoted on a central shaft 122 of said tail cover 11*d* and a peripheral thereof is wrapped around a pull chain 152, one side of said pull-chain disk 151 opposite to said shaft 120 being formed with an installation surface 1510, while the side of said installation surface 1510 being further formed with a shaft pin 1511 pivotally supported in said shaft hole 183*a* of said operating member 183, and on said installation surface 1510 a first through-hole 1512 being formed to be passed through by said branch arm 183*c* of said operating member 183; a pair of positioning plates 155 pivotally supported, at one end thereof, on the other side of said installation surface 1510 by a pair of threaded fixing parts 156, and each having a groove 155*a* in the middle thereof while the other end 155b thereof being presented as a free end 155*b*; in which, a second through-hole 1513 accommodating a tension spring 157 is provided on said installation surface 1510 between two positioning plates 155, and two ends of said tension spring 157 are hooked in said grooves 155*a* of said positioning plates 155, respectively, such that a clamping potential energy may be stored between said free ends 155*b* of said pair of positioning plates 155 for clamping two sides of said branch arm 154*c* of said operating member 154 to keep said operating member 154 in a balance state;

a driven disk 158, coaxial with said pull-chain disk 151, having a central hole 158*a* pivoted on the base end of said central shaft 122 of said tail cover 11*d*, said driven disk 158, including a turning plate 158*b*, provided for extending in said limit portion lie of said tail cover 11*d*, allowed for swinging within said limit portion 11*e*, and further formed with a locking groove 158*c* at the end of said turning plate 158*b*, one end of said driven disk 158 facing toward said pull-chain disk 151 being formed with a projecting core tube 158*d*, born at the outside of said branch arm 183*c* of said operating member 183 and formed with a sliding slot 158*e* around the internal rim of said sleeve 158*d*;

a resilient annular part 159 with tension, embedded in said sliding slot 158*e* of said core tube 158*d* and allowed to frictionally slide on the surface of said sliding slot 158*e*, while formed with a plurality of retaining arms 159*a* which, extending toward the center at two ends of said annular part 159, is allowed for abutting against said branch arm 183*c*; and a protective device 17, including a sensor switch 171 connected to said circuit of said door opener 10' and fixed on said rear cover 11*b*, said sensor switch 171 including an abutting arm 171*a*, located at a position, against which said branch arm 139*a* may be abutted in the swing travel of said pull rod 139, and a rotary arm 172 disposed between said pull rod and said turning plate 158*b*, said rotary arm 172 having a first end 172*a* and a second 172*b*, and the middle of said rotary arm including a shaft pin 172*c* pivotally supported in a shaft hole 11*f* of said limit portion 11*e*, in which said first end 172*a* is accommodated in said locking groove 158*c* of said turning plate 158*b*, while said second end 172*b* is formed with a V-shaped opening 172*d* widened gradually outwardly, the interior of said V-shaped opening 172*d* being born on said pull rod 139, such that said circuit of said door opener 10' is cut off interlocked with the release of the brake so as to automatically switch to a safe manual mode once said pull chain 152 is pulled.

* * * * *